US011107424B2

(12) United States Patent
Calayir et al.

(10) Patent No.: US 11,107,424 B2
(45) Date of Patent: Aug. 31, 2021

(54) BACKLIGHT NOISE REDUCTION SYSTEMS AND METHODS FOR ELECTRONIC DEVICE DISPLAYS

(71) Applicant: Apple Inc., Cupertino, CA (US)

(72) Inventors: Vehbi Calayir, San Jose, CA (US); James E. Brown, San Jose, CA (US)

(73) Assignee: Apple Inc., Cupertino, CA (US)

( * ) Notice: Subject to any disclaimer, the term of this patent is extended or adjusted under 35 U.S.C. 154(b) by 20 days.

(21) Appl. No.: 16/521,332

(22) Filed: Jul. 24, 2019

(65) Prior Publication Data

US 2020/0090600 A1 Mar. 19, 2020

Related U.S. Application Data

(60) Provisional application No. 62/733,032, filed on Sep. 18, 2018.

(51) Int. Cl.
*G09G 3/34* (2006.01)
*G09G 3/36* (2006.01)

(52) U.S. Cl.
CPC ..... *G09G 3/3426* (2013.01); *G09G 3/3611* (2013.01); *G09G 2310/08* (2013.01); *G09G 2320/064* (2013.01)

(58) Field of Classification Search
CPC ..... G09G 2310/08; G09G 2320/0233; G09G 2320/0238; G09G 2320/064; G09G 3/3426; G09G 3/3611
See application file for complete search history.

(56) References Cited

U.S. PATENT DOCUMENTS

2009/0135108 A1* 5/2009 Lindfors ..... G09G 3/3426 345/76
2012/0002133 A1* 1/2012 Yamazaki ..... G09G 3/342 349/61
2016/0031700 A1* 2/2016 Sparks ..... H04R 1/028 381/91
2017/0053610 A1* 2/2017 Yang ..... G09G 3/3611

* cited by examiner

*Primary Examiner* — Temesghen Ghebretinsae
*Assistant Examiner* — Sosina Abebe
(74) *Attorney, Agent, or Firm* — Aikin & Gallant, LLP

(57) ABSTRACT

Aspects of the subject technology relate to control circuitry for light-emitting diodes (LEDs). The control circuitry may include an LED timing controller integrated circuit configured to operate groups of rows of the LEDs with a common randomized row order that mitigates acoustic noise. The LEDs may be implemented in a backlight of a liquid crystal display and the common randomized row order that mitigates acoustic noise may be generated and/or executed to synchronize the LED operation with the operation of the pixels of the liquid crystal display.

20 Claims, 17 Drawing Sheets

BACKLIGHT NOISE REDUCTION SYSTEMS AND METHODS FOR ELECTRONIC DEVICE DISPLAYS

RELATED APPLICATIONS

This application claims the benefit of priority of U.S. Provisional Application No. 62/733,032 filed Sep. 18, 2018 which is incorporated herein by reference.

TECHNICAL FIELD

The present description relates generally to electronic devices with displays, and more particularly, but not exclusively, to backlight noise reduction systems and methods for electronic device displays.

BACKGROUND

Electronic devices such as computers, media players, cellular telephones, set-top boxes, and other electronic equipment are often provided with displays for displaying visual information. Displays such as organic light-emitting diode (OLED) displays and liquid crystal displays (LCDs) typically include an array of display pixels arranged in pixel rows and pixel columns. Liquid crystal displays commonly include a backlight unit and a liquid crystal display unit with individually controllable liquid crystal display pixels.

The backlight unit commonly includes one or more light-emitting diodes (LEDs) that generate light that exits the backlight toward the liquid crystal display unit. The liquid crystal display pixels are individually operable to control passage of light from the backlight unit through that pixel to display content such as text, images, video, or other content on the display.

SUMMARY OF THE DESCRIPTION

In accordance with various aspects of the subject disclosure, an electronic device is provided that includes a display with a liquid crystal display unit and a backlight unit, the backlight unit including an array of light-emitting diodes arranged in rows and columns, the rows arranged in groups of adjacent rows. The electronic device also includes control circuitry configured to identify a plurality of row orders for operation of the rows of each group of adjacent rows, where each row order synchronizes the operation of the rows of the array with operation of the liquid crystal display unit. The control circuitry is also configured to pseudo-randomly select one of the identified plurality of row orders, and operate, concurrently, the rows of each group using the selected one of the identified plurality of row orders.

In accordance with other aspects of the subject disclosure, an electronic device is provided that includes a display with a liquid crystal display unit and a backlight unit, the backlight unit including an array of light-emitting diodes arranged in rows and columns, the rows arranged in groups of adjacent rows. The electronic device also includes control circuitry configured to identify a backlight scan rate at which to operate the array of light-emitting diodes, the backlight scan rate being an integer multiple of an LCD scan rate for the liquid crystal display unit. The control circuitry is also configured to identify a pseudo-random row order for operation of the rows of each of the groups of adjacent rows, and operate, concurrently, the rows of each group using the pseudo-random row order at the identified backlight scan rate.

In accordance with other aspects of the subject disclosure, a method is provided that includes identifying, for multiple groups of adjacent rows of light-emitting diodes in an array of light-emitting diodes in a backlight of a display of an electronic device, a plurality of row orders for operation of the rows of each group of adjacent rows. Each row order synchronizes the operation of the rows of the array with operation of a liquid crystal display unit of the display. The method also includes pseudo-randomly selecting one of the identified plurality of row orders. The method also includes operating, concurrently, the rows of each group using the selected one of the identified plurality of row orders.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
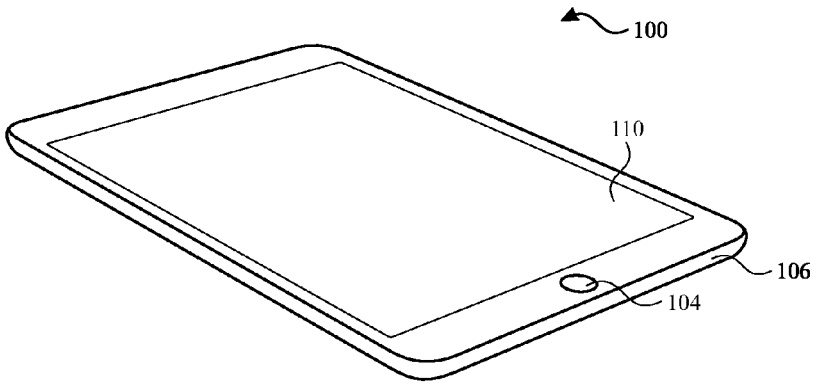
FIG. 1 illustrates a perspective view of an example electronic device having a display in accordance with various aspects of the subject technology.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The subject disclosure provides electronic devices such as cellular telephones, media players, tablet computers, laptop computers, set-top boxes, smart watches, wireless access points, and other electronic equipment that include light-emitting diode arrays such as in backlight units of displays. Displays are used to present visual information and status data and/or may be used to gather user input data. A display includes an array of display pixels. Each display pixel may include one or more colored subpixels for displaying color images.

Each display pixel may include a layer of liquid crystals disposed between a pair of electrodes operable to control the orientation of the liquid crystals. Controlling the orientation of the liquid crystals controls the polarization of backlight from a backlight unit of the display. This polarization control, in combination with polarizers on opposing sides of the liquid crystal layer, allows light passing into the pixel to be manipulated to selectively block the light or allow the light to pass through the pixel.

The backlight unit includes one or more light-emitting diodes (LEDs) such as one or more strings and/or arrays of light-emitting diodes that generate the backlight for the display. In various configurations, strings of light-emitting diodes may be arranged along one or more edges of a light guide plate that distributes backlight generated by the strings to the LCD unit, or may be arranged to form a two-dimensional array of LEDs.

Although examples discussed herein describe LEDs included in display backlights, it should be appreciated that the LED control circuitry and methods described herein can be applied to LEDs implemented in other devices or portions of a device (e.g., in a backlit keyboard or a flash device).

Backlight (BL) control circuitry for the backlight unit includes backlight row drivers and backlight column drivers that control one or more light-emitting diodes (LEDs) such as an array of LEDs arranged in LED rows and LED columns. In some operational scenarios, during operation of the rows of LEDs, some electronic components of the backlight may be operated at frequencies that are audible to the human ear (e.g., frequencies below 20 kHz).

In accordance with various aspects of the subject disclosure, the order of operation of the rows of LEDs is randomized (e.g., pseudo-randomized) to mitigate acoustic noise by reducing the magnitude and spreading the frequencies of the noise generated by the backlight. The randomized row operations may be performed such that the row operations are synchronized with the operation of the LCD unit of the display.

An illustrative electronic device having light-emitting diodes is shown in FIG. 1. In the example of FIG. 1, device 100 has been implemented using a housing that is sufficiently small to be portable and carried by a user (e.g., device 100 of FIG. 1 may be a handheld electronic device such as a tablet computer or a cellular telephone). As shown in FIG. 1, device 100 may include a display such as display 110 mounted on the front of housing 106. Display 110 may be substantially filled with active display pixels or may have an active portion and an inactive portion. Display 110 may have openings (e.g., openings in the inactive or active portions of display 110) such as an opening to accommodate button 104 and/or other openings such as an opening to accommodate a speaker, a light source, or a camera.

Display 110 may be a touch screen that incorporates capacitive touch electrodes or other touch sensor components or may be a display that is not touch-sensitive. Display 110 may include display pixels formed from light-emitting diodes (LEDs), organic light-emitting diodes (OLEDs), plasma cells, electrophoretic display elements, electrowetting display elements, liquid crystal display (LCD) components, or other suitable display pixel structures. Arrangements in which display 110 is formed using LCD pixels and LED backlights are sometimes described herein as an example. This is, however, merely illustrative. In various implementations, any suitable type of display technology may be used in forming display 110 if desired.

Housing 106, which may sometimes be referred to as a case, may be formed of plastic, glass, ceramics, fiber composites, metal (e.g., stainless steel, aluminum, etc.), other suitable materials, or a combination of any two or more of these materials.

The configuration of electronic device 100 of FIG. 1 is merely illustrative. In other implementations, electronic device 100 may be a computer such as a computer that is integrated into a display such as a computer monitor, a laptop computer, a somewhat smaller portable device such as a wrist-watch device, a pendant device, or other wearable or miniature device, a media player, a gaming device, a navigation device, a computer monitor, a television, or other electronic equipment.

For example, in some implementations, housing 106 may be formed using a unibody configuration in which some or all of housing 106 is machined or molded as a single structure or may be formed using multiple structures (e.g., an internal frame structure, one or more structures that form exterior housing surfaces, etc.). Although housing 106 of FIG. 1 is shown as a single structure, housing 106 may have multiple parts. For example, housing 106 may have upper portion and lower portion coupled to the upper portion using a hinge that allows the upper portion to rotate about a rotational axis relative to the lower portion. A keyboard such as a QWERTY keyboard and a touch pad may be mounted in the lower housing portion, in some implementations. An LED backlight array may also be provided for the keyboard and/or other illuminated portions of device 100.

In some implementations, electronic device 100 may be provided in the form of a computer integrated into a computer monitor. Display 110 may be mounted on a front surface of housing 106 and a stand may be provided to support housing (e.g., on a desktop).

Figure 2:
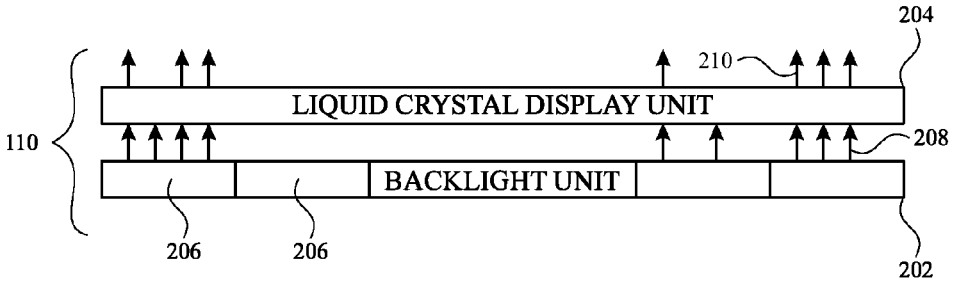
FIG. 2 illustrates a block diagram of a side view of an electronic device display having a backlight unit in accordance with various aspects of the subject technology.

FIG. 2 is a schematic diagram of display 110 in which the display is provided with a liquid crystal display unit 204 and a backlight unit 202. As shown in FIG. 2, backlight unit 202 generates backlight 208 and emits backlight 208 in the direction of liquid crystal display unit 204. Liquid crystal display unit 204 selectively allows some or all of the backlight 208 to pass through the liquid crystal display pixels therein to generate display light 210 visible to a user. Backlight unit 202 includes one or more subsections 206.

In some implementations, subsections 206 may be elongated subsections that extend horizontally or vertically across some or all of display 110 (e.g., in an edge-lit configuration for backlight unit 202). In other implementations, subsections 206 may be square or other rectilinear subsections (e.g., subarrays of a two-dimensional LED array backlight or a two-dimensional array of LED strings). Accordingly, subsections 206 may be defined by one or more strings and/or arrays of LEDs disposed in that subsection. Subsections 206 may define operable zones of BLU 202 that can be controlled individually for local dimming of backlight 208.

Although backlight unit 202 is shown implemented with a liquid crystal display unit, it should be appreciated that a backlight unit such as backlight unit 202 may be implemented in a backlit keyboard, or to illuminate a flash device or otherwise provide illumination for an electronic device.

Figure 3:
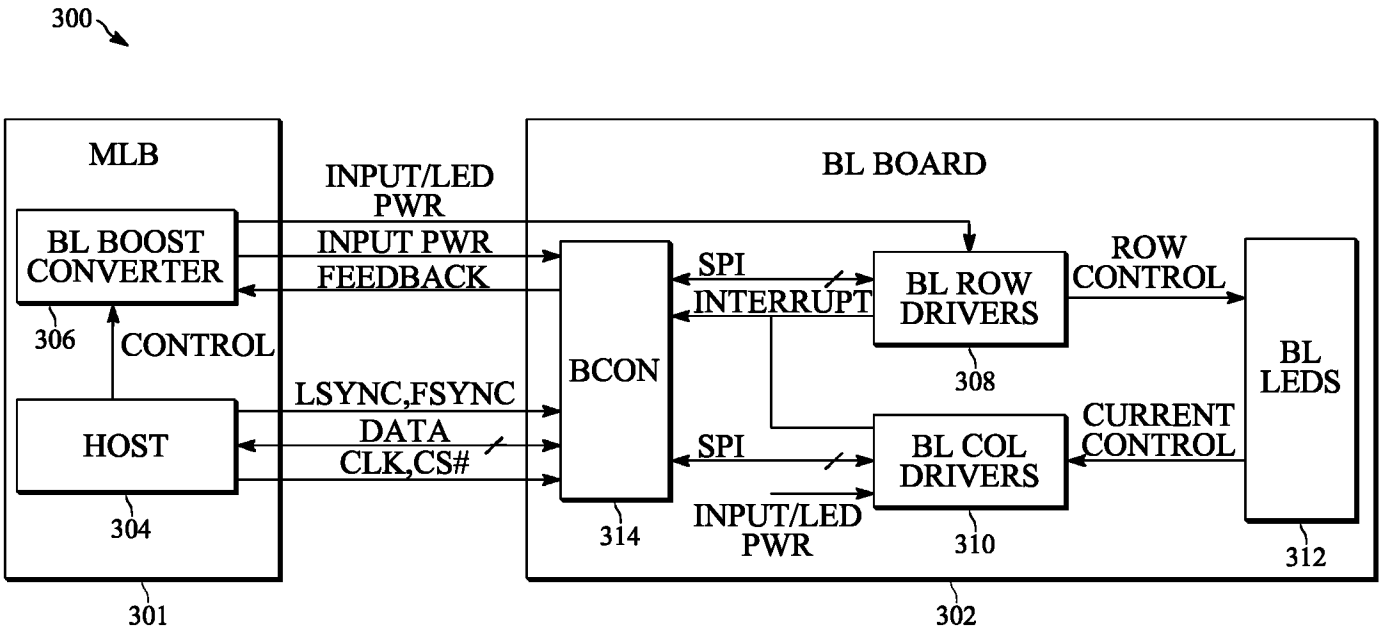
FIG. 3 illustrates a schematic diagram of light-emitting diode (LED) control circuitry in accordance with various aspects of the subject technology.

FIG. 3 shows a schematic diagram of exemplary circuitry for electronic device 100 including host circuitry and LED circuitry such as backlight circuitry for display 110. For example, device circuitry 300 of FIG. 3 may include a backlight board 302 that can be implemented in backlight unit 202 or other LED lighting devices.

In the example of FIG. 3, device circuitry 300 includes a main logic board (MLB) 301 having host circuitry 304 and includes backlight control circuitry that includes backlight controller (BCON) integrated circuit 314, backlight row driver integrated circuits 308, backlight column driver integrated circuits 310, and backlight LEDs 312. As shown, LEDs 312 are operated by BL row driver ICs 308 and BL column driver ICs 310 based on commands/signals from backlight controller IC 314. In this example, backlight controller IC 314, backlight row driver IC 308, backlight column driver IC 310, and backlight LEDs 312 are implemented on a common backlight board 302. The backlight controller 314, backlight row drivers 308, and backlight column drivers 310 can communicate via a communication protocol (e.g., synchronous serial communication (SPI)). The backlight row drivers 308 and backlight column drivers 310 can send interrupt signals to the backlight controller 314 for specific interrupt conditions. Backlight controller IC 314 receives control signals from host circuitry 304.

In the example of FIG. 3, a power supply for backlight unit 202 is provided on MLB 301. In this example, the power supply for backlight unit 202 is implemented as a boost converter 306 mounted on the same MLB as host circuitry 304. However, it should be appreciated that the power supply for backlight unit 202 may be implemented as any DC/DC converter. The boost converter 306 provides input power to the backlight controller 314 and also provides input/LED power to the backlight row drivers 308 and backlight column drivers 310. The arrangement shown in FIG. 3, in which LEDs 312 are operated by BL row driver ICs 308 and BL column driver ICs 310 based on commands from backlight controller IC 314, provides various advantages over conventional backlight arrangements including that a single high-speed link is provided between host circuitry 304 and the backlight control circuitry, analog and digital chips are separated and implemented in different processing nodes, frame memory for the backlight LEDs 312 is provided in a single chip (e.g., BCON 314) for self-refresh of the backlight unit, data transfer bandwidth usage is reduced via dedicated data links for each of BL row driver ICs 308 and BL column driver ICs 310 from BCON 314, and board-level routing for backlight board 302 is improved.

Host circuitry 304 may include one or more different types of storage such as hard disk drive storage, nonvolatile memory (e.g., flash memory or other electrically-programmable-read-only memory), volatile memory (e.g., static or dynamic random-access-memory), magnetic or optical storage, permanent or removable storage and/or other non-transitory storage media configure to store static data, dynamic data, and/or computer readable instructions for processing circuitry in host circuitry 304. Processing circuitry in host circuitry 304 may be used in controlling the operation of device 100. Processing circuitry in host circuitry 304 may sometimes be referred to herein as system circuitry or a system-on-chip (SOC) for device 100.

The processing circuitry may be based on a processor such as a microprocessor and other suitable integrated circuits, multi-core processors, one or more application specific integrated circuits (ASICs) or field programmable gate arrays (FPGAs) that execute sequences of instructions or code, as examples. In one suitable arrangement, host circuitry 304 may be used to run software for device 100, such as internet browsing applications, email applications, media playback applications, operating system functions, etc.

As shown in FIG. 3, backlight timing controller integrated circuit 314 on the backlight substrate 302 receives backlight data from host circuitry 304 for the electronic device via a high speed link. Backlight row driver integrated circuits 308 on the backlight substrate 302 connect a high voltage power rail to the LEDs 312 via a plurality of high-side switches. Backlight column driver integrated circuits 310 are operable by BCON IC 314 to adjust the amount of current through each LED or string of LEDs 312 and provide individual PWM dimming for each LED or string of LEDs 312. The host circuitry 304 and backlight timing controller integrated circuit 314 can communicate via multiple high speed data links (e.g., 2).

In one suitable example, rows of LEDs 312 are operated in groups by row driver ICs 308 and column driver ICs 310. The grouping or segmentation of the array of LEDs 312 can increase the duty cycle and reduce peak currents for operation of the LED array.

Figure 4:
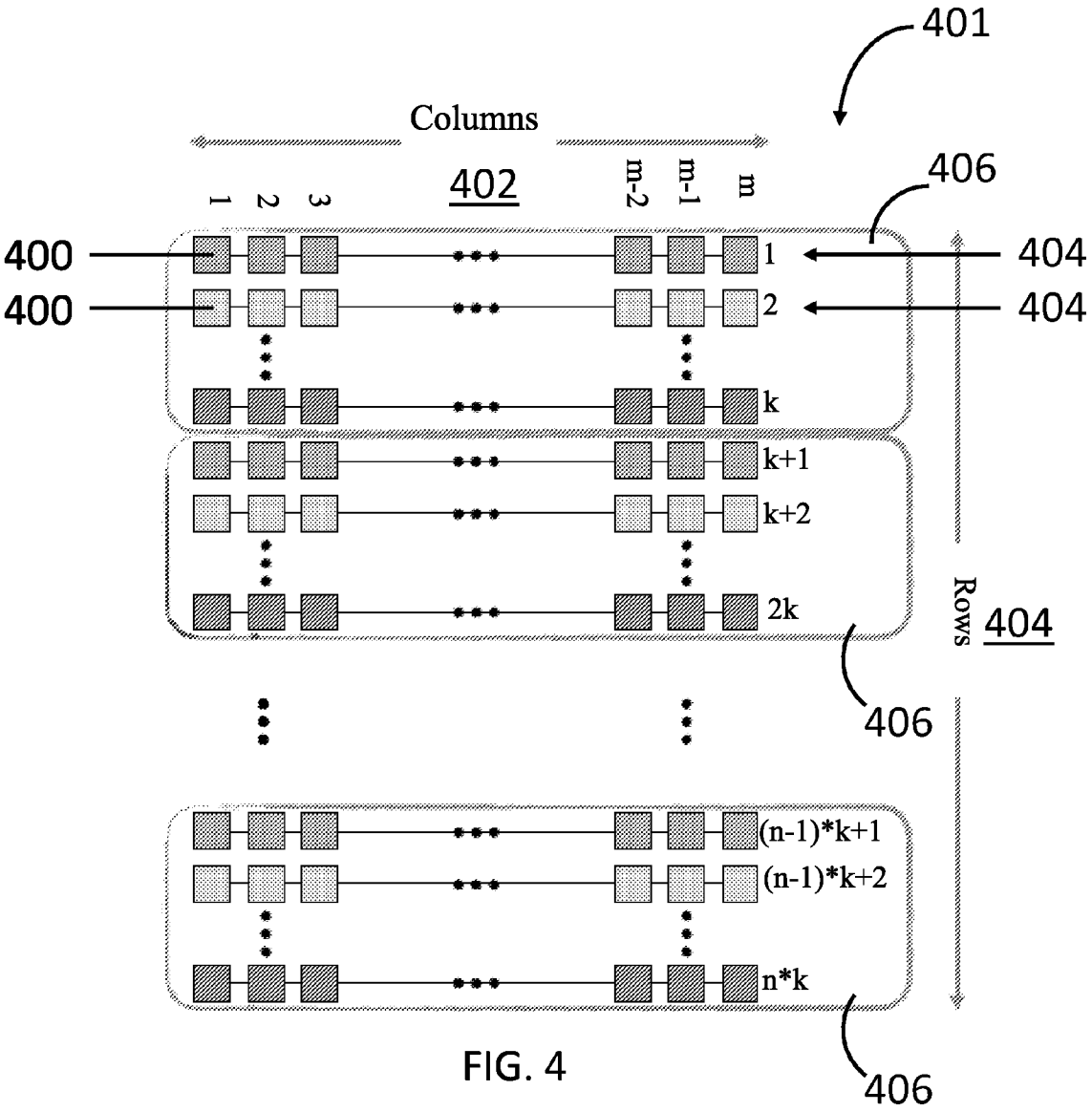
FIG. 4 illustrates a group-based operation of rows of LEDs of a display backlight in accordance with various aspects of the subject technology.

FIG. 4 illustrates how groups 406 of rows 404 of LEDs 400 (e.g., each representing one or more of LEDs 312 of FIG. 3) can be operated in a group-based row operation. In the example of FIG. 4, LED array 401 includes LEDs 400 arranged in rows 404 and columns 402. LEDs 400 may be individual LEDs 312 or may be strings of series-coupled LEDs (e.g., with four or more individual LEDs coupled in series to a current controller of one of column driver ICs 310). As indicated, rows 404 may be operated in groups 406 such that one or more rows 404 in each group 406 is operated at the same time as the corresponding row(s) in the other groups 406. As indicated in the figure, array 401 may include a number m columns, a number n groups 406 each having a number k rows, and a total of n*k rows. As indicated in the figure, the first row in each group 406 is operated at the same time, the second row in each group 406 is operated at the same time, and so on until the k-th row in each group is operated at the same time, although the first, second, third, etc. rows in each group may be operated non-sequentially and/or pseudo-randomly to mitigate acoustic noise generated by the backlight.

Figure 5:
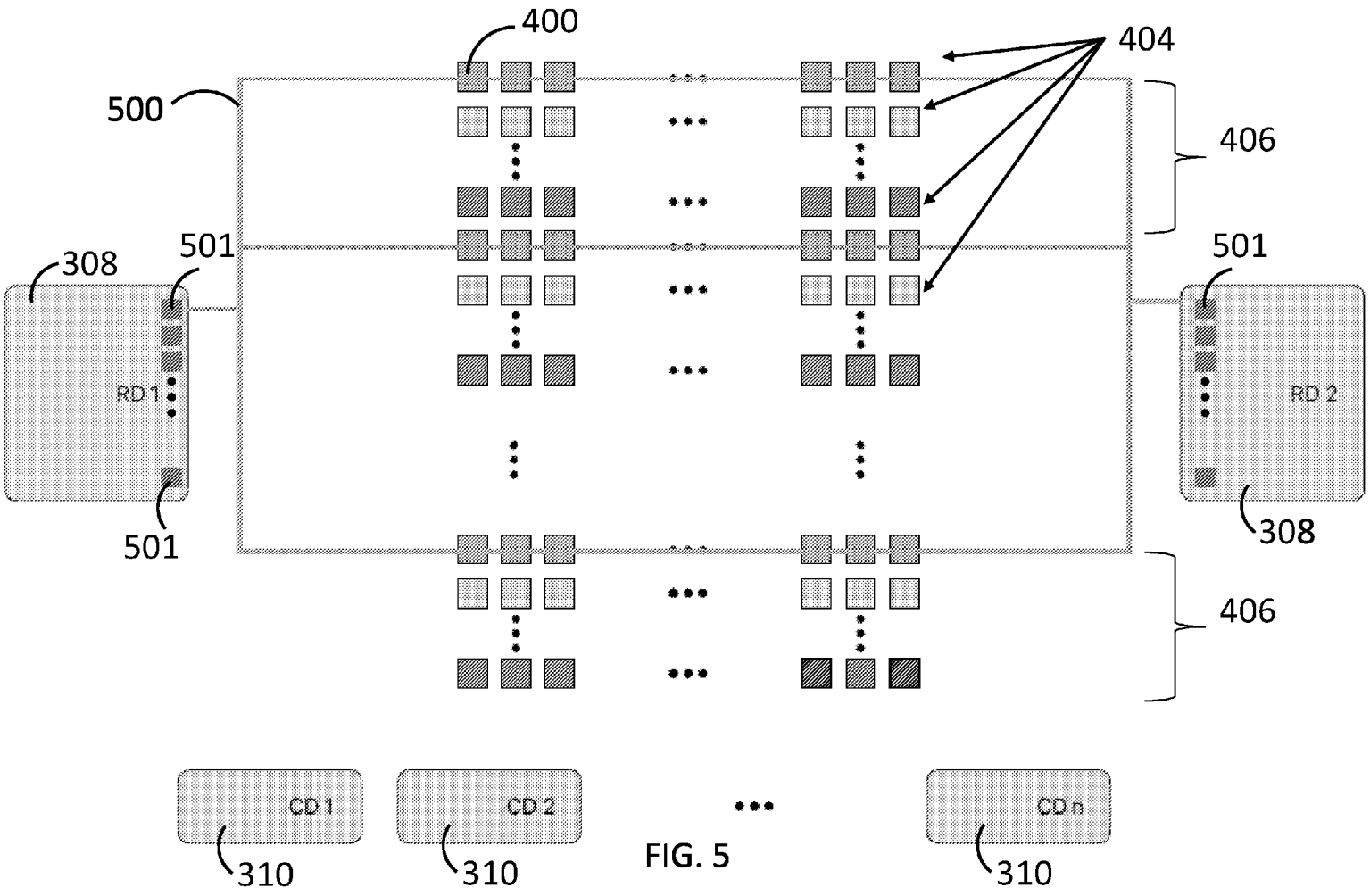
FIG. 5 illustrates an exemplary implementation of row driver electrical routing for group-based operation of rows of LEDs of a display backlight in accordance with various aspects of the subject technology.

An exemplary layout of traces for coupling the first row 404 of each group 406 to a common high-side switch in a row driver IC 308 is shown in FIG. 5. In the example of FIG. 5, the first row 404 in all groups 406 is shorted together by traces 500 and coupled to a common high-side switch 501 in row driver IC 308. Each row driver IC 308 may include a number of high-side switches equal to or greater than the number of rows in groups 406. In the example of FIG. 5, two row driver ICs 308, one on each side of array 401, are provided to drive array 401 from both sides. However, it should be appreciated that single-side driving of array 401 with a single row driver IC 308 can also be provided. The second row 404 in all groups 406 may also be shorted together coupled to a common high-side switch 501 in row driver IC 308, and so forth including the k-th row 404 in all groups 406 being shorted together and coupled to a common high-side switch 501 in row driver IC 308.

Figure 6:
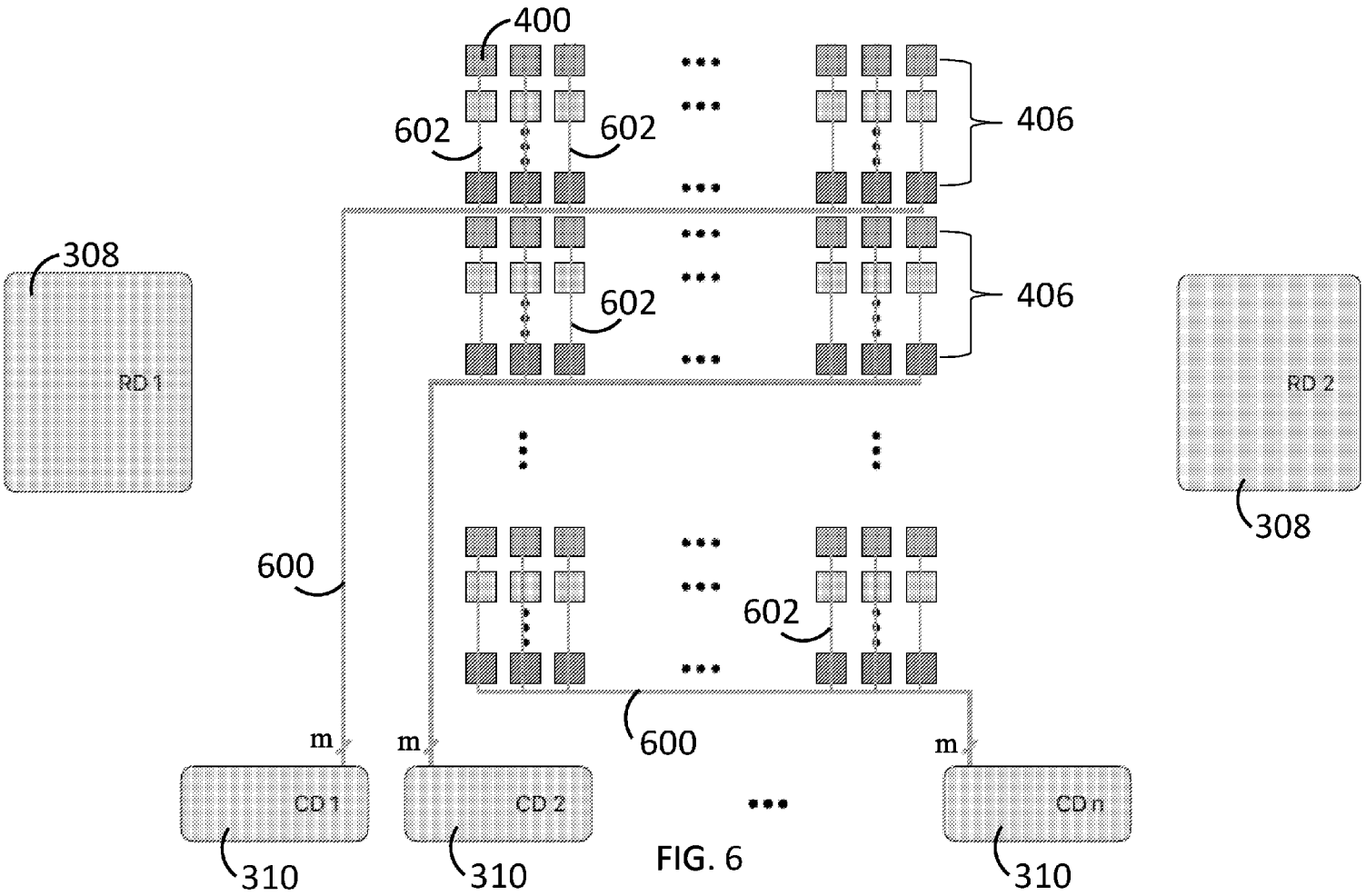
FIG. 6 illustrates an exemplary implementation of column driver electrical routing for group-based operation of rows of LEDs of a display backlight in accordance with various aspects of the subject technology.

FIG. 6 illustrates an exemplary layout of column driver traces for group-based operation of LEDs 400. In the example of FIG. 6, each group 406 is operated by a corresponding column driver IC 310 having a number of channels equal to the number of columns 402. As indicated in the figure, m traces 600 may run between each column driver IC 310 and m column lines 602. In this example, the LEDs 400 (or strings of LEDs) in the same column 402 within one group 406 are shorted together by a column line 602 and connected to one channel of the corresponding CD IC 310.

However, it should be appreciated that the column driver layout described in connection with FIG. 6 is merely illustrative and other arrangements are contemplated. For example, in one suitable arrangement, a column intermixing layout is provided in which column driver ICs 310 are programmed to run as a number of smaller drivers in parallel.

Figure 7:
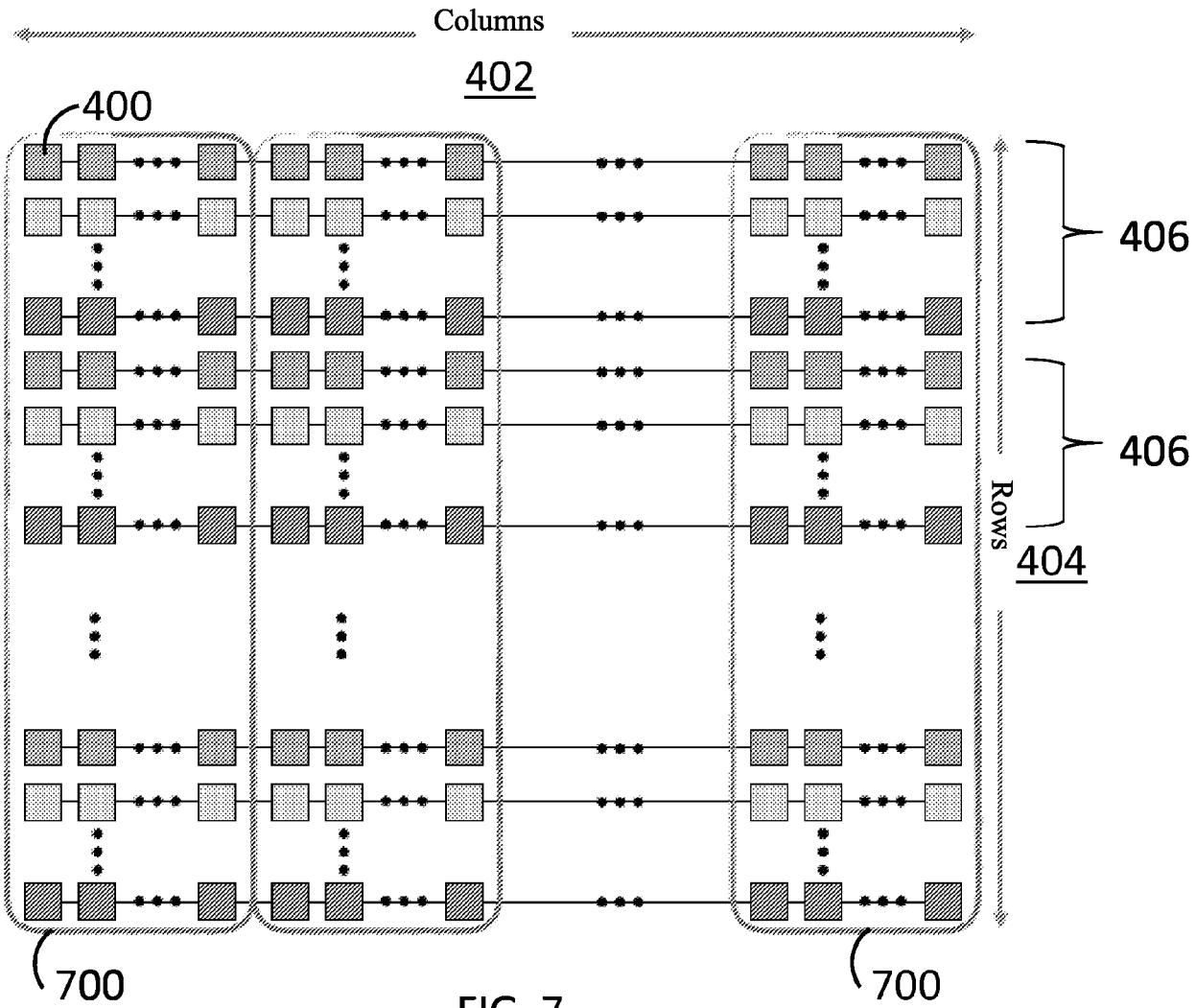
FIG. 7 illustrates a column-intermixed group-based operation of rows of LEDs of a display backlight in accordance with various aspects of the subject technology.
Figure 8:
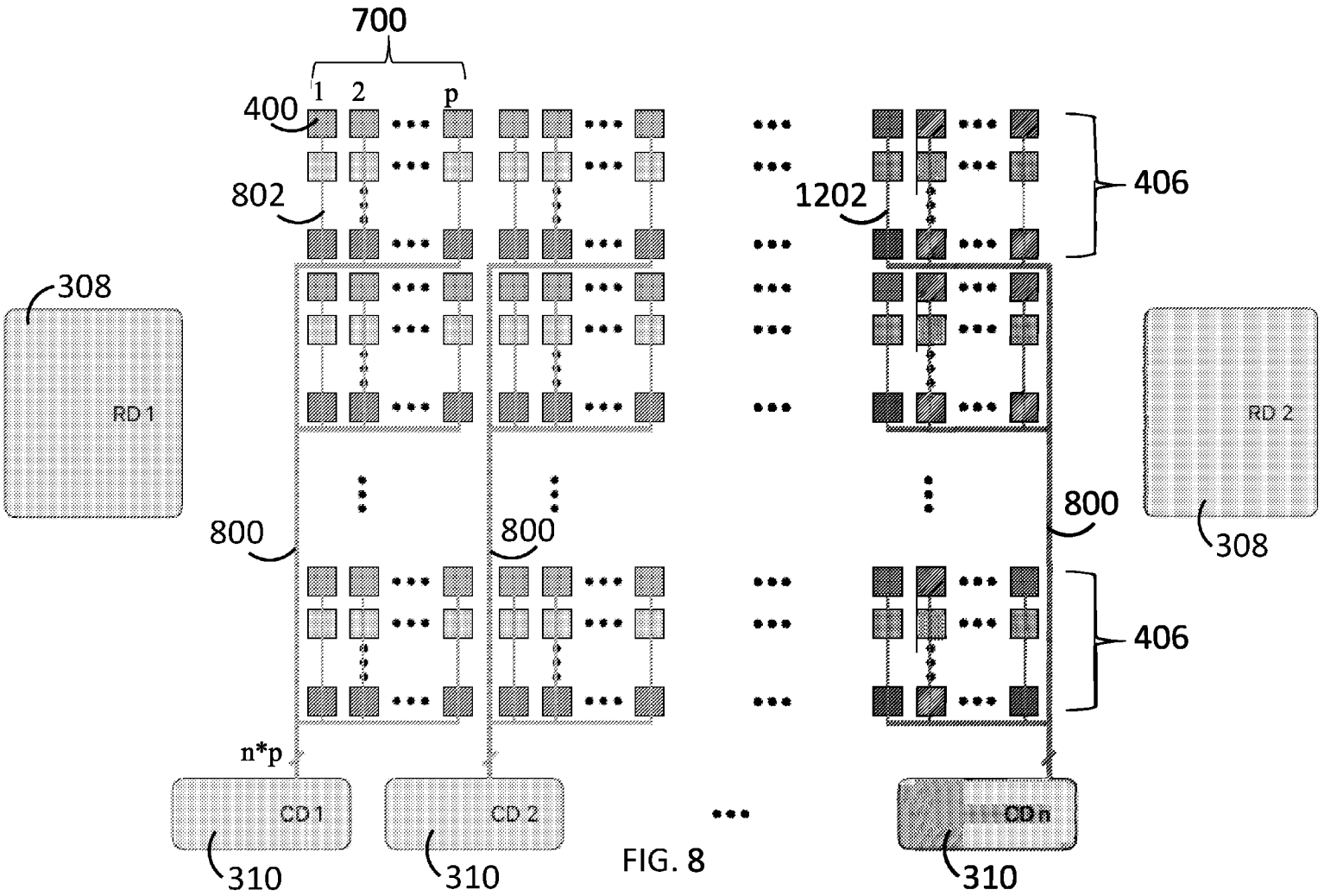
FIG. 8 illustrates an exemplary implementation of column driver electrical routing for column-intermixed group-based operation of rows of LEDs of a display backlight in accordance with various aspects of the subject technology.

FIG. 7 illustrates how, in a column-intermixing layout, groups (subsets) 700 of p columns, each spanning a portion of a group 406 of rows 404, can be operated by a common column driver integrated circuit 310. FIG. 8 illustrates an exemplary layout of column driver traces for a column-intermixed group-based operation of LEDs 312/400 (see FIGS. 3 and 4). As shown in FIG. 8 a number n*p traces 800, where n is the number of groups 406 and p is the number of columns in each subset 700, run between each column driver IC 310 and p column lines 802 in each of n groups 406. In this example, the LEDs 400 (or strings of LEDs) in the same column 402 within one group 406 are shorted together by a column line 802 and connected to one channel of the corresponding CD IC 310.

Figure 9:
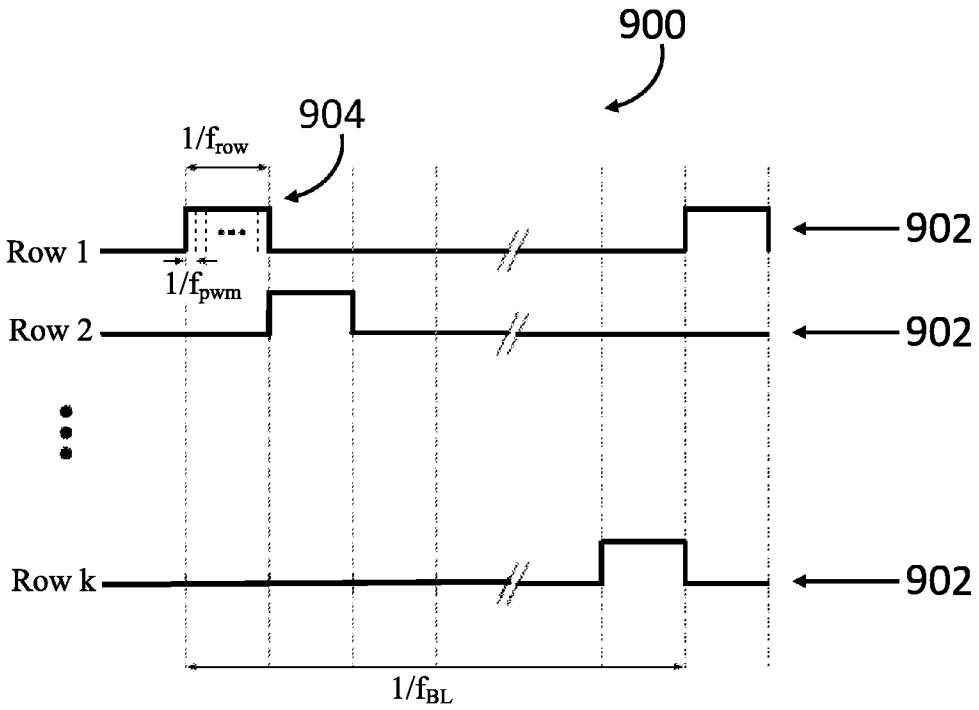
FIG. 9 illustrates a timing diagram for operation of rows of LEDs of a display backlight in accordance with various aspects of the subject technology.

BCON 314 (see FIG. 3) may cooperate with row driver ICs 308 and column driver ICs 310 arranged as described herein to operate rows 404 and columns 402 of LEDs 312/400 (see FIGS. 3 and 4). FIG. 9 is a timing diagram 900 illustrating a sequential operation of k rows in each group 406. In the example of FIG. 9, signal 902 for each row includes an on pulse 904 for that row, that sequentially follows the previous (adjacent) row. In FIG. 9, the time corresponding to the operation of each row ($1/f_{row}$), the time corresponding to a pulse width modulation (PWM) cycle for the LEDs in that row ($1/f_{pwm}$), and the time corresponding to a backlight scan ($1/f_{BL}$) are indicated.

Figure 10:
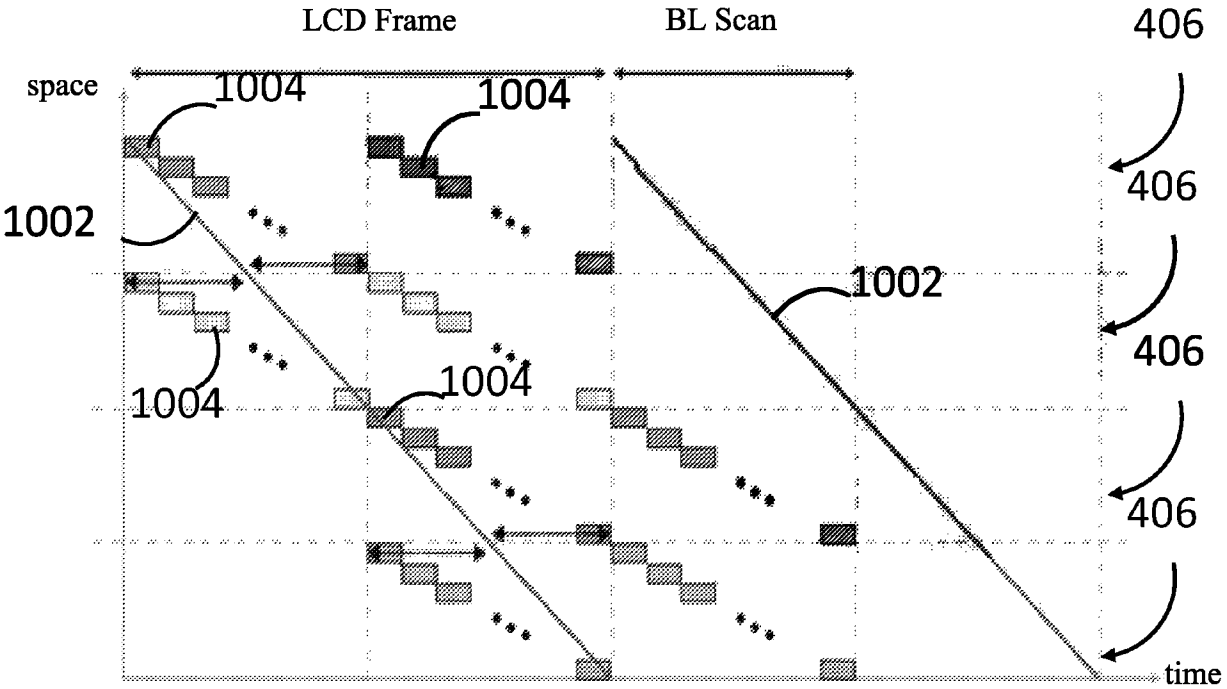
FIG. 10 illustrates an LCD synchronization error that can occur during operation of rows of LEDs of a display backlight in accordance with various aspects of the subject technology.

However, as indicated in FIG. 10, a sequential operation of backlight rows 404 in each of several groups 406 that are operated concurrently, can result in a synchronization error with the operation of LCD unit 204. In particular, FIG. 10 shows the progression of an LCD scan 1002 (e.g., sequential operation of rows of LCD pixels in LCD unit 204 over a display frame) overlaid on the backlight row operation indicators 1004 in each of several groups (regions) 406. Synchronized operation would appear with all backlight row operation indicators 1004 coinciding with an LCD scan 1002. However, as shown, if care is not taken the LCD unit and backlight unit can be out of sync.

In accordance with various aspects of the subject disclosure, synchronization of LCD unit 204 and backlight unit 202 can be achieved by, for example, (i) maintaining a scan rate of the array of LEDs 312/400 (see FIGS. 3 and 4) above a threshold that is based on the rate of LCD scan 1002 and a number of the different groups, and/or (ii) operating the rows within each of multiple corresponding groups in a non-sequential order.

Figure 11:
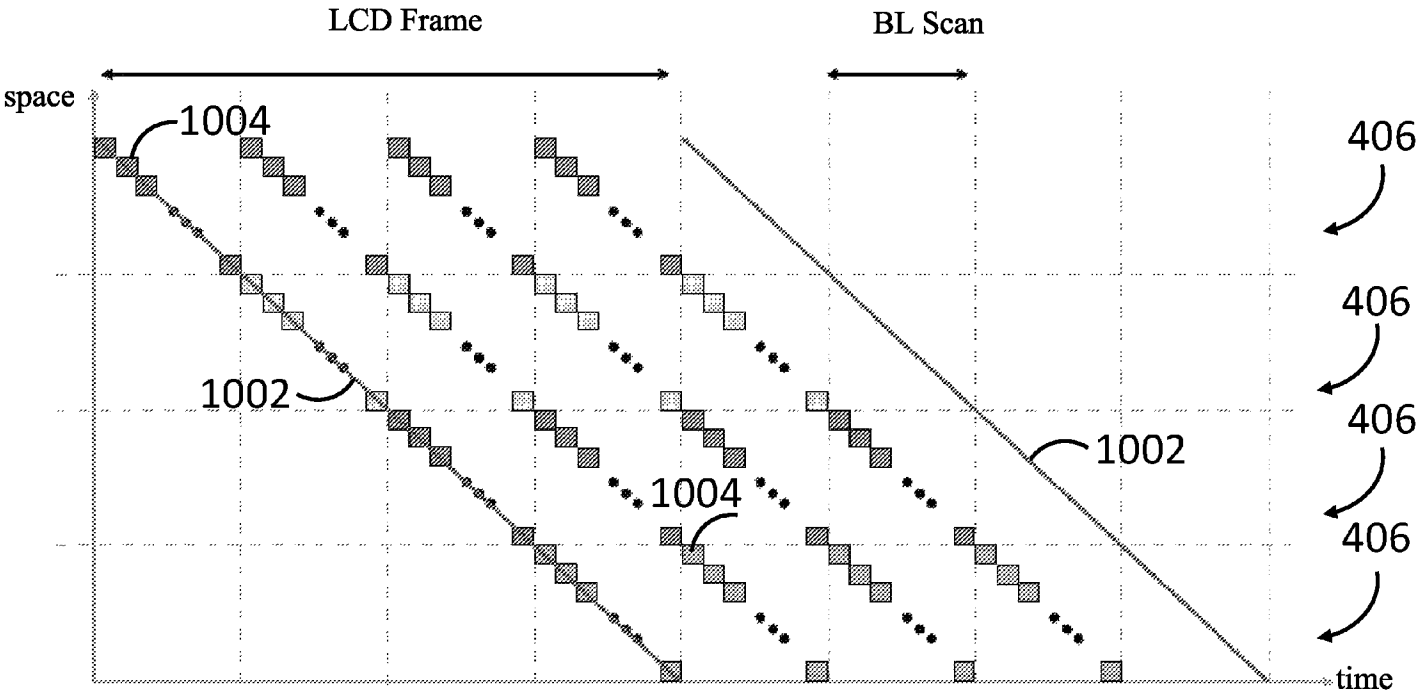
FIG. 11 illustrates an LCD synchronized operation of rows of LEDs of a display backlight based on a minimum backlight scan rate in accordance with various aspects of the subject technology.

FIG. 11 shows an example in which the rows of LEDs 312/400 (see FIGS. 3 and 4) in each group 406 are operated in a sequential order, with a backlight scan rate (e.g., 1/(BL Scan) in FIG. 11) of the array of LEDs 312/400 (see FIGS. 3 and 4) is maintained above a threshold that is based on the rate (e.g., 1/(LCD Frame in FIG. 11) of LCD scan 1002 and a number of the different groups. In the example of FIG. 11, the backlight scan rate is equal to n*RR, where n is the number of groups 406 and RR is the maximum refresh rate of LCD unit 204. As shown, in this arrangement, backlight row operation indicators 1004 coincide with or progress in accordance with an LCD scan 1002, even with concurrent operation of rows in different groups 406. More generally, higher backlight scan rates can be applied. For example, for a 120 Hz LCD scan rate, and a backlight with four groups 406 of rows 404 of LEDs 312/400 (see FIGS. 3 and 4), the backlight scan rate may be maintained at or above 480 Hz.

Figure 12:
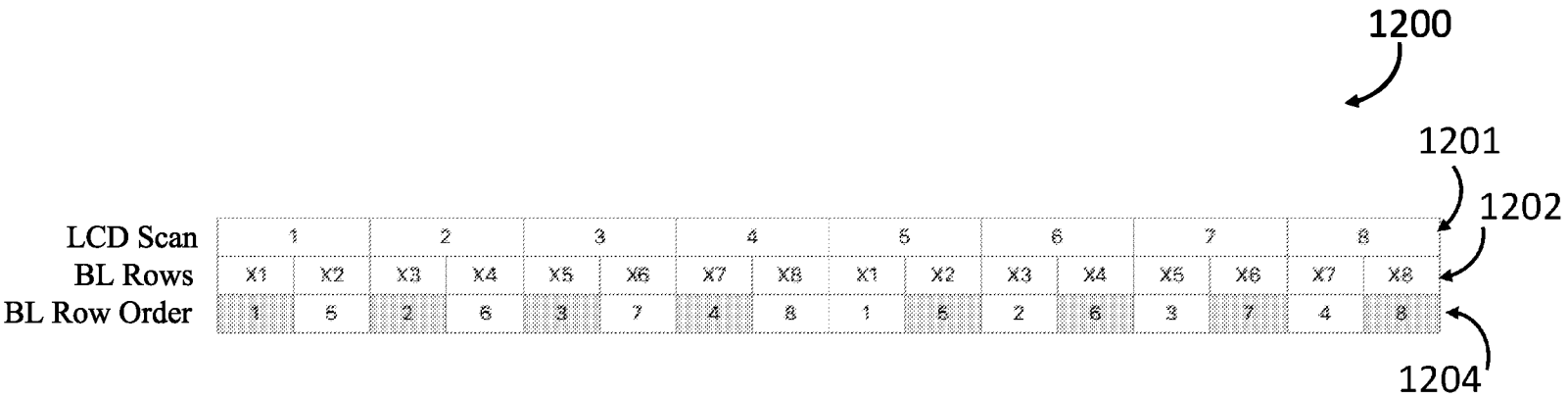
FIG. 12 shows a table illustrating row-reordering operations for LCD synchronized operation of rows of LEDs of a display backlight in accordance with various aspects of the subject technology.

As noted above, synchronization between LCD unit 204 and backlight unit 202 (see FIG. 2) can also, or alternatively, be achieved by operating the rows within each of multiple corresponding groups 406 in a non-sequential order. FIG. 12 is a table 1200 illustrative of a row ordering for operation of backlight LED rows 404 for synchronization with LCD scan 1002.

In the example of FIG. 12, a row of backlight execution times 1202 (including row execution times X1, X2 . . . X8) is aligned with a row of LCD scan times 1201 and a row of backlight row numbers 1204, each corresponding to a row 404 in a group 406. In this example, the first row in each group (row 1) is executed first (e.g., illuminated during row execution time X1), the fifth row (row 5) in each group is executed second (e.g., illuminated during row execution time X2), the second row (row 2) in each group is executed third (e.g., illuminated during row execution time X3), and so forth as indicated in the table. In can be seen in table 1200 that the backlight row operation is synchronized with the LCD operations in this example.

Figure 13:
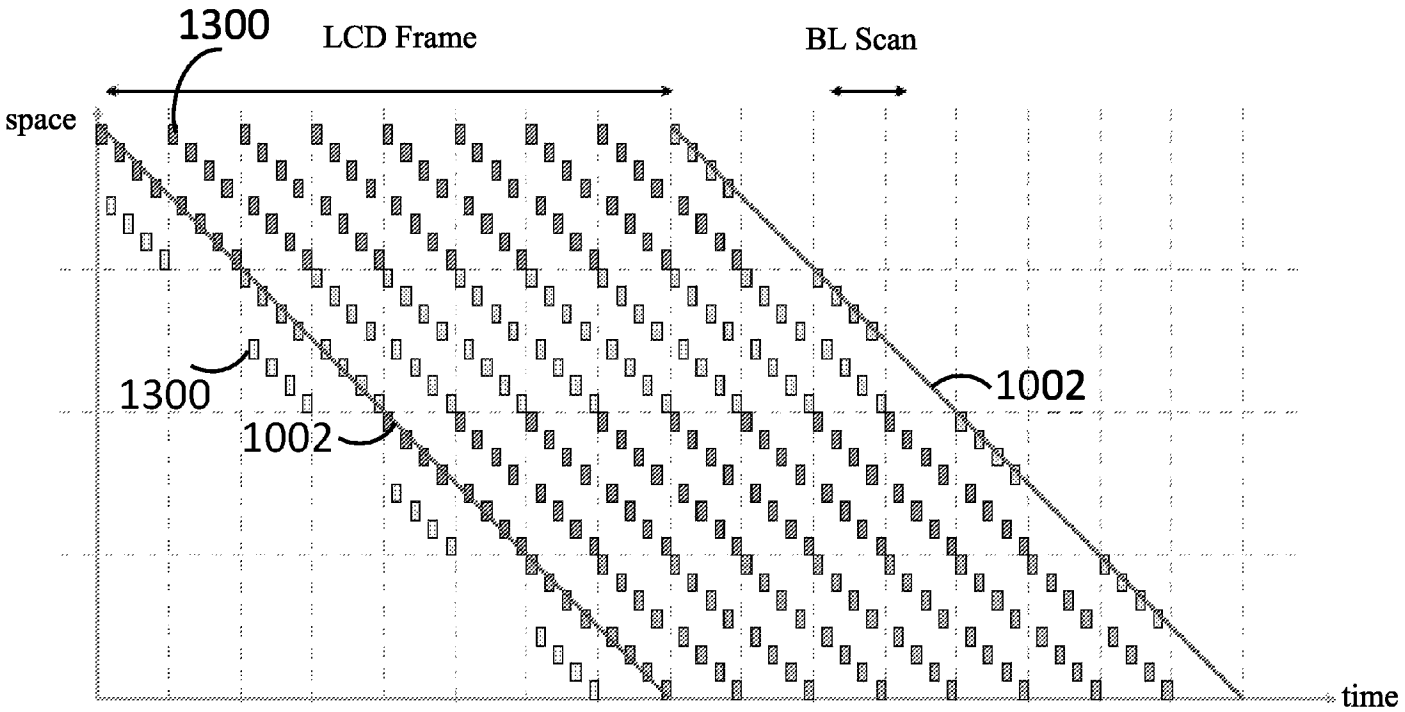
FIG. 13 illustrates an LCD synchronized operation of rows of LEDs of a display backlight based on row-reordering operations in accordance with various aspects of the subject technology.

Execution of rows 404 of groups 406 as indicated in table 1200 is illustrated in FIG. 13. As can be seen in FIG. 13, each LCD scan 1002 coincides with backlight row operation indicators 1300 for some rows during a non-sequential operation of the rows in each group 406. It should be appreciated that the row ordering indicated in table 1200 is merely illustrative and other non-sequential row orders can be executed, and more or less than eight rows per group 406 can result in different non-sequential row orderings for LCD synchronization.

Figure 15:
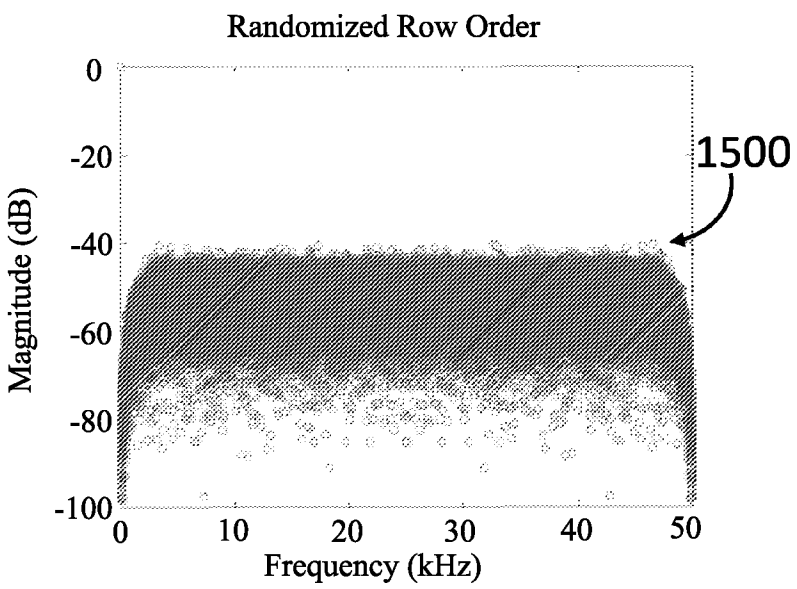
FIG. 15 shows a graph of reduced and spread acoustic noise that may be produced at various frequencies by an array of LEDs operating with a randomized row order in accordance with various aspects of the subject technology.
Figure 14:
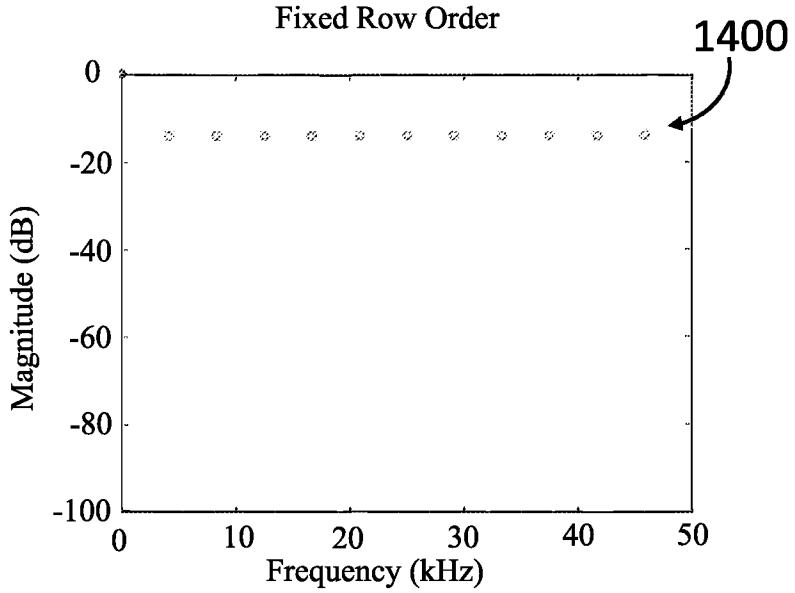
FIG. 14 shows a graph of acoustic noise that may be produced at various frequencies by an array of LEDs operating with a fixed row order.

It should also be appreciated that, even with a non-sequential row ordering as indicated in FIGS. 12 and 13, if the same non-sequential order of row operations is repeated, acoustic noise that is audible to the user can occur. For example, FIG. 14 shows an example of noise magnitudes 1400 at various frequencies that can occur when a fixed row ordering is applied in a backlight having twelve rows in each group 406. FIG. 15 shows, for comparison, the noise magnitudes 1500 at various frequencies that may occur when randomized row ordering of the rows within each group 406, as described hereinafter, is applied. As indicated in FIG. 15, the noise generated by the backlight is reduced and spread evenly over a broader range of frequencies, providing a white noise that is less noticeable than the distinct frequencies indicated in FIG. 14.

FIGS. 16-19 illustrate various aspects of examples of randomized row ordering operations that can be performed that mitigate acoustic noise generated by the backlight and preserve the synchronization of the backlight LEDs with the pixels of the LCD unit.

Figure 16:
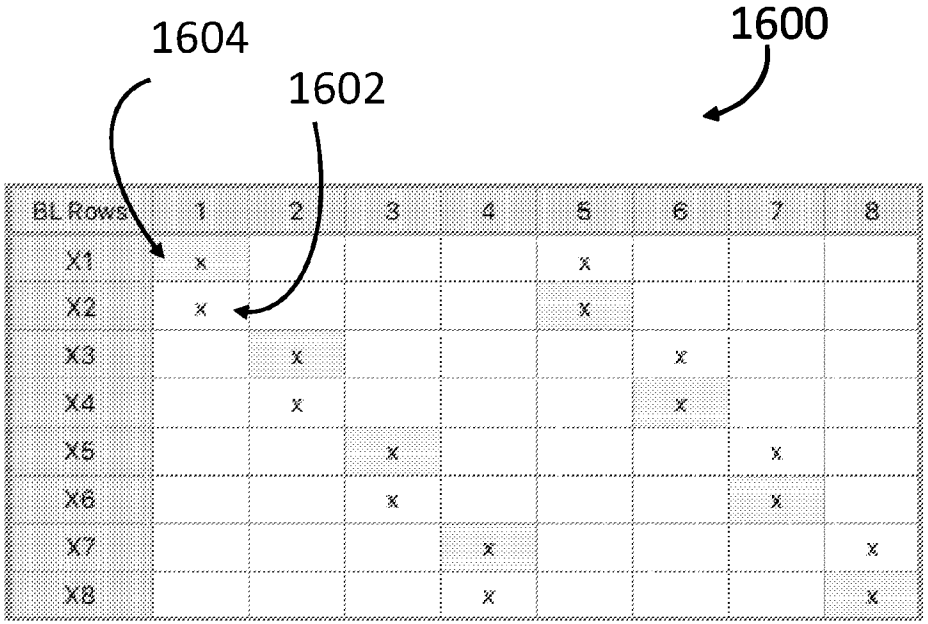
FIG. 16 shows a table illustrating candidate row orders and selected row orders operating a group of rows of LEDs in accordance with various aspects of the subject technology.

For example, FIG. 16 shows a table 1600 in which the backlight row execution times X1, X2, etc. of table 1200 are listed vertically and the backlight row numbers (1, 2, 3, etc.) of table 1200 are listed horizontally. In table 1600, candidate row order indicators 1602 (each shown as an "x") are provided for any row-number/row-time entry which is a candidate for execution that synchronizes the backlight row operations with the LCD scan 1002. Using the constraint that only one candidate row order indicator 1602 in each column and each row can be selected (e.g., because each row is only to be executed once per one self-refresh cycle), multiple possible row orders for operation of the rows of each group 406 can be identified, each of which synchronizes the operation of the rows of the backlight with the operation of LCD unit 204. In the example of FIG. 16, selected row indicators 1604 (grey-highlighted) indicate one possible row ordering that can be applied to synchronize the operation of the rows of the backlight with the operation of LCD unit 204.

The selected row indicators 1604 in the example of FIG. 16 correspond to the row ordering shown and described above in connection with FIGS. 12 and 13. However, it should be appreciated that, if (for example) the other candidate row order indicators 1602 in the first column of table 1600 were selected, a different combination of other selected candidates is possible in which all of the selected candidates still satisfy the constraint that only one candidate row order indicator 1602 in each column and each row can be selected.

Figure 17:
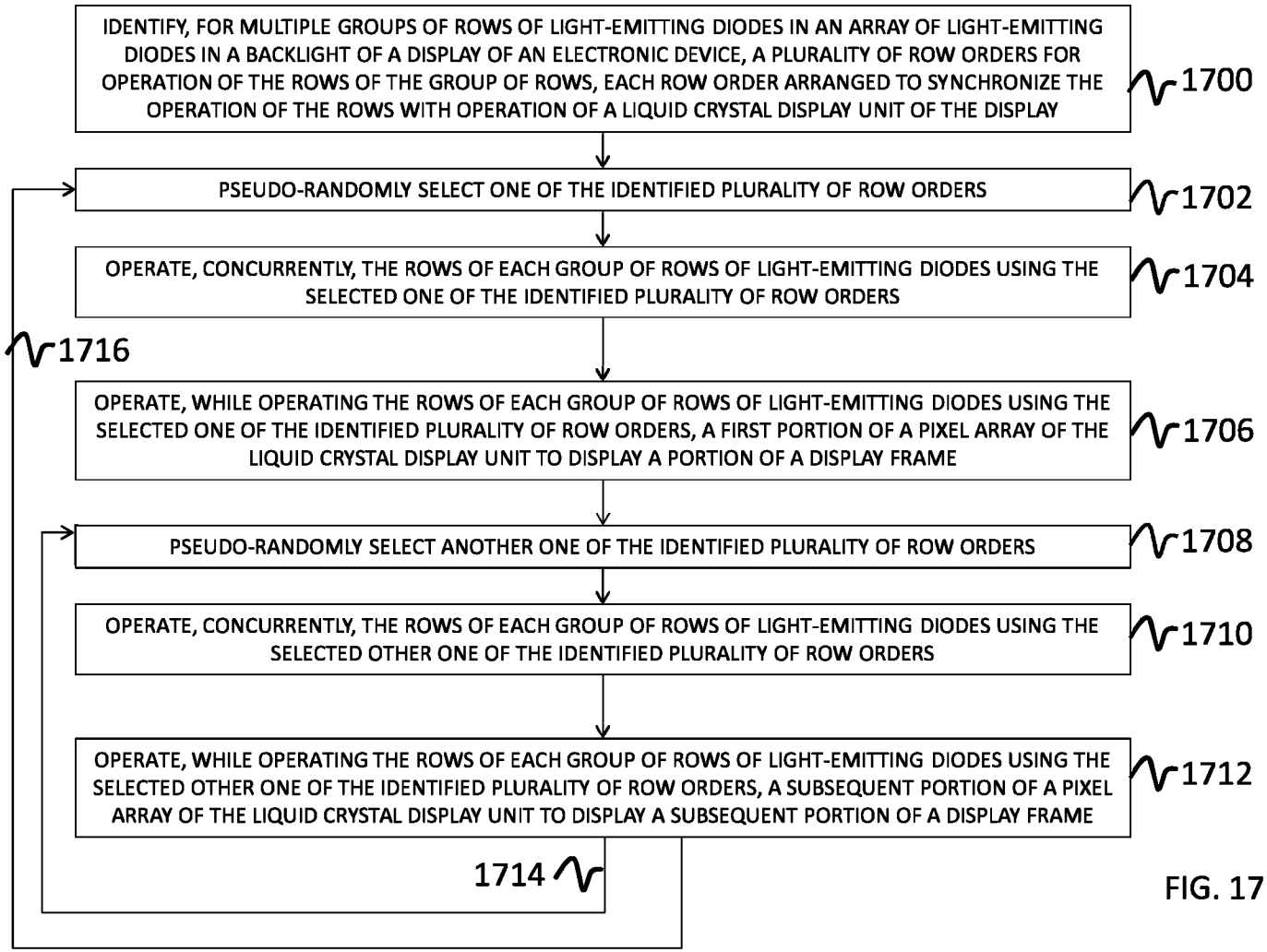
FIG. 17 is an example flow chart of illustrative operations that may be performed for an LCD-synchronized, randomized operation of rows of LEDs of a display backlight in accordance with various aspects of the subject technology.

By identifying several row orders for groups 406, each of which provides synchronization with the LCD scan, and pseudo-randomly choosing from those identified row orders for different backlight scans, the row ordering within groups 406 can be randomized to mitigate acoustic noise from the backlight. FIG. 17 is a flow chart of illustrative operations that can be performed for randomizing the row ordering within groups 406 by pseudo-randomly selecting from row orders that preserve synchronization with the LCD scan.

FIG. 17 depicts a flow chart of an example process for randomized row operation of backlight LEDs (e.g., to mitigate acoustic noise) in accordance with various aspects of the subject technology. For explanatory purposes, the example process of FIG. 17 is described herein with reference to the components of FIGS. 1, 2, and 3. Further for explanatory purposes, the blocks of the example process of FIG. 17 are described herein as occurring in series, or linearly. However, multiple blocks of the example process of FIG. 17 may occur in parallel. In addition, the blocks of the example process of FIG. 17 need not be performed in the order shown and/or one or more of the blocks of the example process of FIG. 17 need not be performed.

In the depicted example flow diagram, at block 1700, control circuitry such as host circuitry 304 and/or BCON 314 (see FIG. 3) may identify, for multiple groups such as groups 406 of rows 404 of light-emitting diodes 314/400 in an array 401 of light-emitting diodes in a backlight 202 (see FIG. 2) of a display 110 of an electronic device 100 (see FIG. 1), a plurality of row orders for operation of the rows of the group of rows, each row order arranged to synchronize the operation of the rows with operation of a liquid crystal display unit of the display (e.g., as described above in connection with FIG. 16). For example, one of the plurality of row orders may correspond to the row order of table 1200 of FIG. 12 using selected row indicators 1604 of table 1600 of FIG. 16. Another of the row orders may be generated by initially selecting a different row execution time for row 1 and selecting other candidate row indicators 1602 (see FIG. 16) under the constraint that only one candidate in each column and row is selected. Using this constraint, each of the plurality of row orders synchronizes the operation of the rows with operation of a liquid crystal display unit of the display.

At block 1702, the control circuitry pseudo-randomly selects one of the identified plurality of row orders.

At block 1704, the control circuitry (e.g., including BCON 314, row drivers 308 and column drivers 310 of FIG. 3) operates, concurrently, the rows of each group of rows of light-emitting diodes using the selected one of the identified plurality of row orders (e.g., by operating the rows of each group in the same order as the rows of all other groups, according to the selected one of the identified plurality of row orders).

At block 1706, the control circuitry (e.g., including separate LCD control circuitry for LCD unit 204 of FIG. 2) operates, while the backlight control circuitry is operating the rows of each group of rows of light-emitting diodes using the selected one of the identified plurality of row orders, a first portion of a pixel array of the liquid crystal display unit to display a portion of a display frame.

At block 1708, the control circuitry pseudo-randomly selects another one of the identified plurality of row orders.

At block 1710, the control circuitry (e.g., including BCON 314, row drivers 308 and column drivers 310 of FIG. 3) operates, concurrently, the rows of each group of rows of light-emitting diodes using the selected other one of the identified plurality of row orders (e.g., by operating the rows of each group in the same order as the rows of all other groups, according to the selected other one of the identified plurality of row orders).

At block 1712, the control circuitry (e.g., the separate LCD control circuitry for LCD unit 204 of FIG. 2) operates, while the backlight control circuitry is operating the rows of each group of rows of light-emitting diodes using the selected other one of the identified plurality of row orders, a subsequent portion of the pixel array of the liquid crystal display unit to display a subsequent portion of the display frame.

As indicated by arrow 1714, the operations of blocks 1708, 1710, and 1712 can be repeated. For example, the operations of blocks 1708, 1710, and 1712 can be repeated for multiple backlight scans until the display frame (corresponding to one LCD scan such as LCD scan 1002 of FIG. 10, 11, or 13 above or FIG. 19 below) is complete. As indicated by arrow 1716, when the display frame is complete, the control circuitry may return to block 1702 to repeat the operations of blocks 1702, 1704, 1706, 1708, 1710, and 1712 for a next display frame.

However, it should be appreciated that row orderings that are not pre-selected to preserve synchronization with the LCD scan can also be used without sacrificing synchronization with the LCD scan, as long as the backlight scan rate is maintained at or above an integer multiple (e.g., the number of rows (n*k) in the array) of the LCD scan rate RR as described above.

Figure 18:
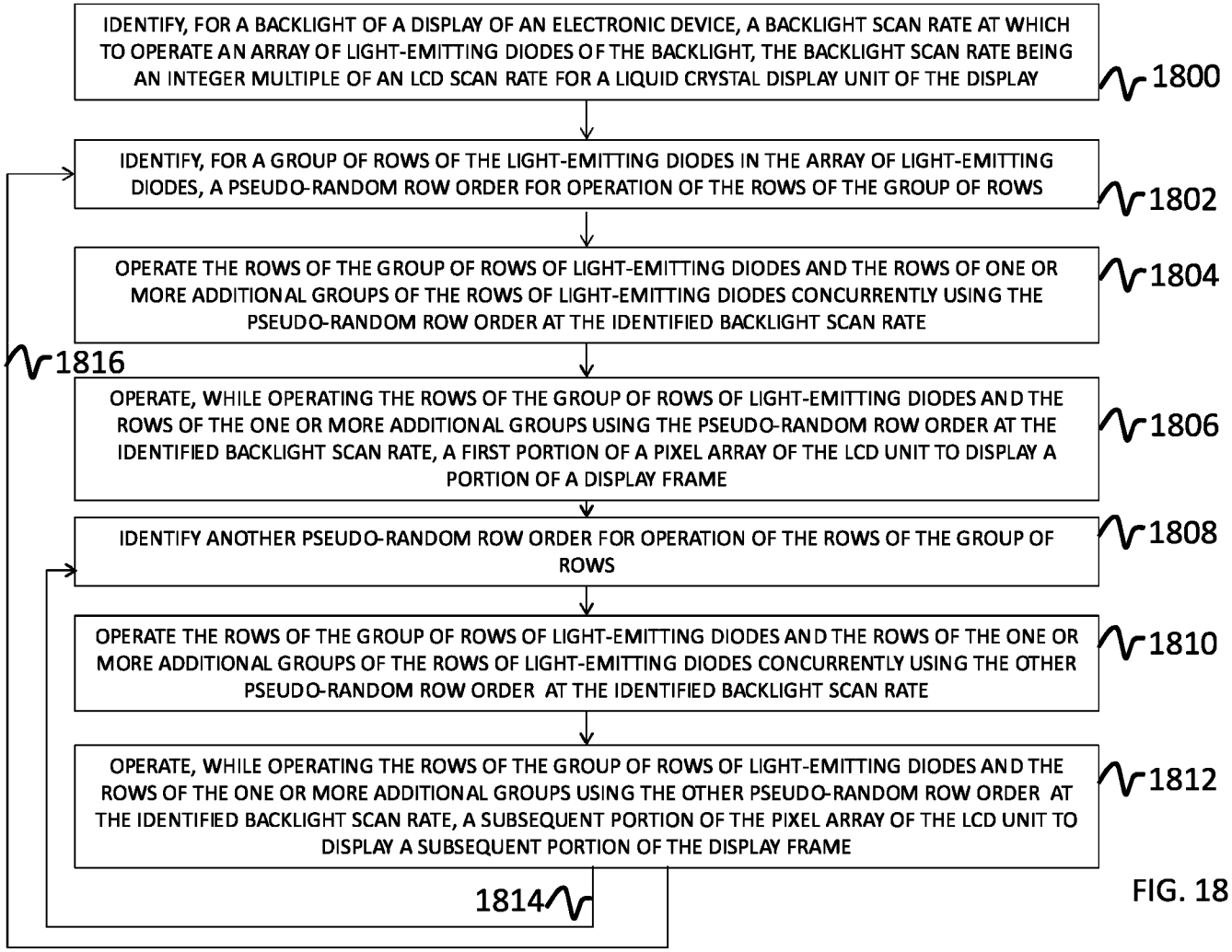
FIG. 18 is another example flow chart of illustrative operations that may be performed for an LCD-synchronized, randomized operation of rows of LEDs of a display backlight in accordance with various aspects of the subject technology.

FIG. 18 depicts a flow chart of another example process for randomized row operation of backlight LEDs (e.g., to mitigate acoustic noise) by randomizing the row ordering within groups 406 by generating pseudo-random row orderings and applying the pseudo-random row orderings at a backlight scan rate that is maintained at or above n*k*RR in accordance with various aspects of the subject technology. For explanatory purposes, the example process of FIG. 18 is described herein with reference to the components of FIGS. 1, 2, and 3. Further for explanatory purposes, the blocks of the example process of FIG. 18 are described herein as occurring in series, or linearly. However, multiple blocks of the example process of FIG. 18 may occur in parallel. In addition, the blocks of the example process of FIG. 18 need not be performed in the order shown and/or one or more of the blocks of the example process of FIG. 18 need not be performed.

In the depicted example flow diagram, at block 1800, control circuitry such as host circuitry 304 and/or BCON 314 (see FIG. 3) identifies, for a backlight 202 (see FIG. 2) of a display 110 of an electronic device 100 (see FIG. 1), a backlight scan rate at which to operate an array 401 (see FIG. 4) of light-emitting diodes 312/400 (see FIGS. 3 and 4) of the backlight, the backlight scan rate being an integer multiple of an LCD scan rate for a liquid crystal display unit 204 (see FIG. 2) of the display. The integer multiple may be, for example, the number of rows of LEDs in the array of LEDs.

At block 1802, the control circuitry identifies, for a group 406 of rows of light-emitting diodes in the array of light-emitting diodes in the backlight, a pseudo-random row order for operation of the rows of the group of rows. In contrast to the plurality of row orders identified at block 1700 of FIG. 17, the pseudo-random row order may be identified without ensuring that the pseudo-random row order synchronizes the backlight LEDs with the LCD scan rate (e.g., at low backlight frame rates). Instead, in this example, the synchronization of the LCD pixels with the backlight LEDs operating in the pseudo-random row order is preserved using the identified backlight scan rate (e.g., n*k*RR).

At block 1804, the control circuitry (e.g., including BCON 314, row drivers 308 and column drivers 310 of FIG. 3) operates the rows of the group 406 (see FIG. 4) of rows of light-emitting diodes and the rows of one or more additional groups 406 of the rows of light-emitting diodes concurrently using the pseudo-random row order at the identified backlight scan rate.

At block 1806, the control circuitry (e.g., including separate LCD control circuitry for LCD unit 204 of FIG. 2) operates, while the backlight control circuitry is operating the rows of the group 406 and the rows of the one or more additional groups 406 (see FIG. 4) using the pseudo-random row order at the identified backlight scan rate, a first portion of a pixel array of the liquid crystal display unit to display a portion of a display frame.

At block 1808, the control circuitry identifies another pseudo-random row order for operation of the rows of the group of rows.

At block 1810, the control circuitry (e.g., including BCON 314, row drivers 308 and column drivers 310 of FIG. 3) operates the rows of the group 406 (see FIG. 4) of rows of light-emitting diodes and the rows of one or more additional groups 406 of the rows of light-emitting diodes concurrently using the other pseudo-random row order at the identified backlight scan rate.

At block 1812, the control circuitry (e.g., including separate LCD control circuitry for LCD unit 204 of FIG. 2) operates, while the backlight control circuitry is operating the rows of the group 406 and the rows of the one or more additional groups 406 using the other pseudo-random row order at the identified backlight scan rate, a subsequent portion of the pixel array of the liquid crystal display unit to display a subsequent portion of the display frame.

As indicated by arrow 1814, the operations of blocks 1808, 1810, and 1812 can be repeated. For example, the operations of blocks 1808, 1810, and 1812 can be repeated for multiple backlight frames until the display frame (corresponding to one LCD scan such as LCD scan 1002 of FIG. 10, 11, or 13 above or FIG. 19 below) is complete. As indicated by arrow 1816, when the display frame is complete, the control circuitry may return to block 1802 to repeat the operations of blocks 1802, 1804, 1806, 1808, 1810, and 1812 for a next display frame.

Figure 19:
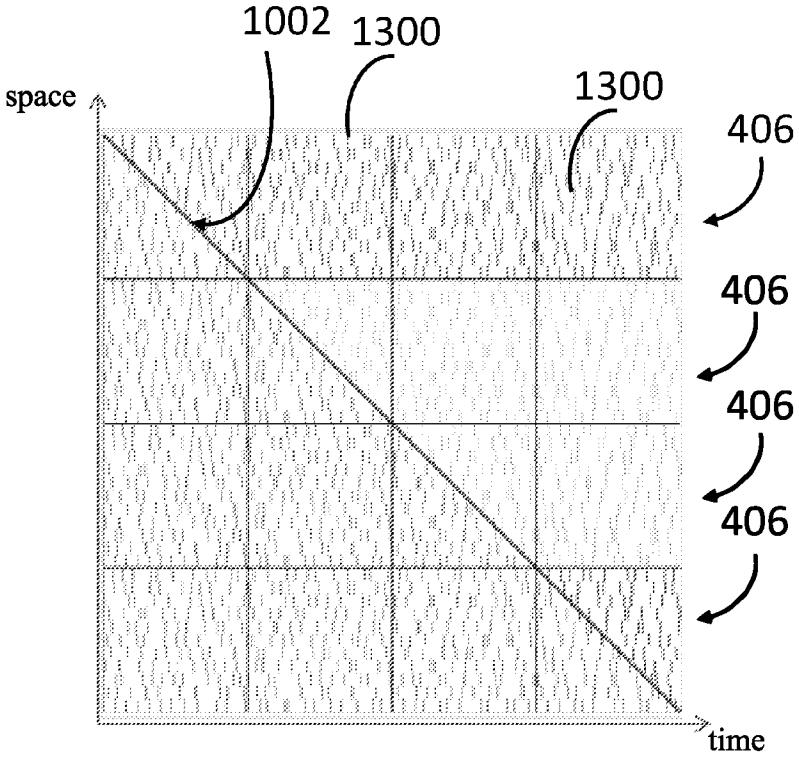
FIG. 19 illustrates LCD-synchronized, randomized operation of rows of LEDs of a display backlight in accordance with various aspects of the subject technology.

FIG. 19 illustrates a space-time diagram in which a randomized row ordering (e.g., generated using the operations described above in connection with FIG. 18) is applied concurrently within each group 406 (see FIG. 4) of rows of LEDs and in which the randomized row ordering is synchronized with LCD scan 1002. As shown, in this arrangement, all of backlight row operation indicators 1300 coincide with or progress in accordance with an LCD scan 1002, even with the randomized and concurrent operation of rows in different groups 406.

In accordance with various aspects of the subject disclosure, an electronic device is provided that includes a display with a liquid crystal display unit and a backlight unit, the backlight unit including an array of light-emitting diodes arranged in rows and columns, the rows arranged in groups of adjacent rows. The electronic device also includes control circuitry configured to identify a plurality of row orders for operation of the rows of each group of adjacent rows, where each row order synchronizes the operation of the rows of the array with operation of the liquid crystal display unit. The control circuitry is also configured to pseudo-randomly select one of the identified plurality of row orders, and operate, concurrently, the rows of each group using the selected one of the identified plurality of row orders.

In accordance with other aspects of the subject disclosure, an electronic device is provided that includes a display with a liquid crystal display unit and a backlight unit, the backlight unit including an array of light-emitting diodes arranged in rows and columns, the rows arranged in groups of adjacent rows. The electronic device also includes control circuitry configured to identify a backlight scan rate at which to operate the array of light-emitting diodes, the backlight scan rate being an integer multiple of an LCD scan rate for the liquid crystal display unit. The control circuitry is also configured to identify a pseudo-random row order for operation of the rows of each of the groups of adjacent rows, and operate, concurrently, the rows of each group using the pseudo-random row order at the identified backlight scan rate.

In accordance with other aspects of the subject disclosure, a method is provided that includes identifying, for multiple groups of adjacent rows of light-emitting diodes in an array of light-emitting diodes in a backlight of a display of an electronic device, a plurality of row orders for operation of the rows of each group of adjacent rows. Each row order synchronizes the operation of the rows of the array with operation of a liquid crystal display unit of the display. The method also includes pseudo-randomly selecting one of the identified plurality of row orders. The method also includes operating, concurrently, the rows of each group using the selected one of the identified plurality of row orders.

Various functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "processor", and "memory" all refer to electronic or other technological devices. These terms exclude people or groups of people. For the purposes of the specification, the terms "display" or "displaying" means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device as described herein for displaying information to the user and a keyboard and a pointing device, such as a mouse or a trackball, by which the user can provide input to the computer. Other kinds of devices can be used to provide for interaction with a user as well; for example, feedback provided to the user can be any form of sensory feedback, such as visual feedback, auditory feedback, or tactile feedback; and input from the user can be received in any form, including acoustic, speech, or tactile input.

Many of the above-described features and applications are implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a stand alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Some of the blocks may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or design All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. An electronic device, comprising:

a display with a liquid crystal display unit and a backlight unit, the backlight unit comprising an array of light-emitting diodes arranged in rows and columns, the rows arranged in groups of adjacent rows; and control circuitry configured to:

identify a plurality of pseudo-randomized row orders for operation of the rows of each group of adjacent rows, wherein each row order synchronizes the operation of the rows of the array of light-emitting diodes of the backlight unit with operation of the liquid crystal display unit;

pseudo-randomly select one of the identified plurality of pseudo-randomized row orders; and operate, concurrently, the rows of each group including a row of a first group and a corresponding row of a second group using the selected one of the identified plurality of pseudo-randomized row orders.

2. The electronic device of claim 1, further comprising liquid crystal display control circuitry configured to operate, while the control circuitry operates the rows of each group using the selected one of the identified plurality of pseudo-randomized row orders, a first portion of a pixel array of the liquid crystal display unit to display a first portion of a display frame.

3. The electronic device of claim 2, wherein the control circuitry is further configured to:

pseudo-randomly select another one of the identified plurality of pseudo-randomized row orders; and operate, concurrently, the rows of each group using the selected other one of the identified plurality of pseudo-randomized row orders.

4. The electronic device of claim 3, wherein the liquid crystal display control circuitry is further configured to operate, while the control circuitry operates the rows of each group using the selected other one of the identified plurality of pseudo-randomized row orders, a subsequent portion of the pixel array of the liquid crystal display unit to display a subsequent portion of a display frame.

5. The electronic device of claim 1, wherein the control circuitry comprises backlight control circuitry including a backlight row driver, the backlight row driver having a plurality of high-side switches, each coupled to at least one row in each of the groups of adjacent rows.

6. The electronic device of claim 5, wherein the backlight control circuitry further comprises a plurality of backlight column drivers, each backlight column driver coupled to one of the groups of adjacent rows.

7. The electronic device of claim 6, wherein the backlight control circuitry is configured to operate, concurrently, the rows of each group using the selected one of the identified plurality of pseudo-randomized row orders by operating the rows of each group in the same order as the rows of all other groups, according to the selected one of the identified plurality of pseudo-randomized row orders.

8. An electronic device, comprising:

a display with a liquid crystal display unit and a backlight unit, the backlight unit comprising an array of light-emitting diodes arranged in rows and columns, the rows arranged in groups of adjacent rows; and control circuitry configured to:

identify a backlight scan rate at which to operate the array of light-emitting diodes, the backlight scan rate being an integer multiple of a liquid crystal display (LCD) scan rate for the LCD unit, the integer multiple of the LCD scan rate based on at least one of a number of rows and a number of groups of the array of light-emitting diodes;

identify a pseudo-random row order for operation of the rows of each of the groups of adjacent rows; and operate, concurrently, the rows of each group including a row of a first group and a corresponding row of a second group using the pseudo-random row order at the identified backlight scan rate, wherein synchronization of the LCD unit with the array of light-emitting diodes of the backlight unit operating in the pseudo-random row order is preserved using the identified backlight scan rate.

9. The electronic device of claim 8, wherein the array of light-emitting diodes includes a number of rows, and wherein the integer multiple is equal to the number of rows.

10. The electronic device of claim 8, further comprising liquid crystal display unit control circuitry configured to operate, while the control circuitry operates the rows of each group using the pseudo-random row order at the identified backlight scan rate, a first portion of a pixel array of the liquid crystal display unit to display a first portion of a display frame.

11. The electronic device of claim 10, wherein the control circuitry is further configured to:

identify another pseudo-random row order for operation of the rows of each of the groups of adjacent rows; and operate, concurrently, the rows of each group using the other pseudo-random row order at the identified backlight scan rate.

12. The electronic device of claim 11, wherein the liquid crystal display control circuitry is further configured to operate, while the control circuitry operates the rows of each group using the other pseudo-random row order at the identified backlight scan rate, a subsequent portion of the pixel array of the liquid crystal display unit to display a subsequent portion of a display frame.

13. The electronic device of claim 8, wherein the control circuitry comprises backlight control circuitry including a backlight row driver, the backlight row driver having a plurality of high-side switches, each coupled to at least one row in each of the groups of adjacent rows.

14. The electronic device of claim 13, wherein the backlight control circuitry further comprises a plurality of backlight column drivers, each backlight column driver coupled to one of the groups of adjacent rows.

15. The electronic device of claim 14, wherein the backlight control circuitry is configured to operate, concurrently, the rows of each group using the pseudo-random row order at the identified backlight scan rate by operating the rows of each group in the same order as the rows of all other groups, according to the pseudo-random row order and at the identified backlight scan rate.

16. A method, comprising:

identifying, for multiple groups of adjacent rows of light-emitting diodes in an array of light-emitting diodes in a backlight of a display of an electronic device, a plurality of pseudo-randomized row orders for operation of the rows of each group of adjacent rows, wherein each row order synchronizes the operation of the rows of the array of light-emitting diodes of the backlight unit with operation of a liquid crystal display unit of the display;

pseudo-randomly selecting one of the identified plurality of pseudo-randomized row orders; and operating, concurrently, the rows of each group including a row of a first group and a corresponding row of a second group using the selected one of the identified plurality of pseudo-randomized row orders.

17. The method of claim 16, further comprising operating, while operating the rows of each group using the selected one of the identified plurality of pseudo-randomized row orders, a first portion of a pixel array of the liquid crystal display unit of the display to display a first portion of a display frame.

18. The method of claim 17, further comprising:

pseudo-randomly selecting another one of the identified plurality of pseudo-randomized row orders; and operating, concurrently, the rows of each group using the selected other one of the identified plurality of pseudo-randomized row orders.

19. The method of claim 17, further comprising operating, while operating the rows of each group using the selected other one of the identified plurality of pseudo-randomized row orders, operating a subsequent portion of the pixel array of the liquid crystal display unit to display a subsequent portion of the display frame.

20. The method of claim 16, wherein operating, concurrently, the rows of each group using the selected one of the identified plurality of pseudo-randomized row orders comprises operating the rows of each group in the same order as the rows of all other groups, according to the selected one of the identified plurality of pseudo-randomized row orders.

* * * * *